United States Patent [19]

Tschawow

[11] Patent Number: 4,764,045

[45] Date of Patent: Aug. 16, 1988

[54] WRITING INSTRUMENT WITH RESERVOIR HAVING PERPENDICULAR FIBERS

[75] Inventor: Antoaneta Tschawow, Hamburg, Fed. Rep. of Germany

[73] Assignee: Koh-I-Noor Rapidograph, Inc., Bloomsbury, N.J.

[21] Appl. No.: 39,136

[22] Filed: Apr. 16, 1987

[30] Foreign Application Priority Data

Apr. 16, 1986 [DE] Fed. Rep. of Germany ..... 3612792

[51] Int. Cl.[4] ..... B43K 8/02

[52] U.S. Cl. ..... 401/198; 401/199; 401/223

[58] Field of Search ..... 401/198, 199, 223, 227, 401/283

[56] References Cited

U.S. PATENT DOCUMENTS

| | | | |
|---|---|---|---|
| 2,554,654 | 5/1951 | Wittnebert . | |
| 2,681,041 | 6/1954 | Zootner . | |
| 2,684,052 | 7/1954 | Rickmeyer | 401/199 X |
| 2,983,254 | 5/1961 | Silver . | |
| 3,113,336 | 12/1963 | Langnickel | 401/199 X |
| 3,604,817 | 9/1971 | Funahashi . | |
| 3,614,247 | 10/1971 | Otsuka . | |
| 3,614,248 | 10/1971 | Otsuka . | |
| 3,627,868 | 12/1971 | Funahashi . | |
| 3,830,576 | 8/1974 | Kohno et al. . | |
| 3,843,270 | 10/1974 | Kiriu et al. . | |
| 3,933,965 | 1/1976 | Gallone et al. . | |
| 4,269,526 | 5/1981 | Dupre . | |
| 4,556,336 | 12/1985 | Sano et al. . | |

FOREIGN PATENT DOCUMENTS

| | | | |
|---|---|---|---|
| 3343004 | 11/1985 | Fed. Rep. of Germany . | |
| 676144 | 11/1929 | France | 401/198 |
| 1325535 | 3/1963 | France . | |
| 1439018 | 9/1966 | France . | |
| 89617 | 7/1967 | France | 401/198 |
| 2302868 | 10/1976 | France . | |
| 279972 | 11/1964 | Netherlands | 401/199 |
| 7701595 | 8/1978 | Netherlands | 401/199 |
| 903559 | 8/1962 | United Kingdom . | |
| 2150506 | 7/1985 | United Kingdom . | |

*Primary Examiner*—Steven A. Bratlie

*Attorney, Agent, or Firm*—David H. Semmes; Warren E. Olsen

[57] ABSTRACT

A writing instrument includes a writing fluid reservoir in the form of a fiber body, in which there is a coaxially extending writing fluid conductor with capillary conduits. The fibers of the reservoir extend at right angles to and radially with respect to the longitudinal axis of the conductor and communicate with it in a fluid-conducting manner.

4 Claims, 1 Drawing Sheet

WRITING INSTRUMENT WITH RESERVOIR HAVING PERPENDICULAR FIBERS

BACKGROUND OF THE INVENTION

1. Field of the Invention

The invention relates to a writing instrument having a reservoir for writing fluid in the form of a fiber body, which has capillary conduits in the direction of the longitudinal extension of the fibers, and having a housing which receives the writing fluid reservoir and holds a writing tip in its front end. A writing fluid conductor extends coaxially in the writing fluid reservoir and communicates in a fluid-conducting manner with the writing tip.

2. Brief Description of the Prior Art

In a known writing instrument of this kind (British Pat. No. 2,150,506), the writing fluid reservoir comprises a substantially cylindrical fiber body in which the fibers extend in the direction of the longitudinal axis of the cylinder and hence parallel to the writing fluid conductor disposed coaxially in the fiber body. In this known writing instrument, during use for writing or for drawing, the fibers transport the writing fluid received by the reservoir, on the one hand in the direction of the coaxially extending capillary conduits and on the other hand in the radial direction with respect to the conductor. Since the capillary forces in the axially extending capillary conduits are greater than the forces acting on the writing fluid in the radial direction, however, some of the writing fluid contained in the reservoir does not even reach the coaxially extending conductor. Instead, ink is retained in the radially outer regions of the reservoir, so that the reservoir cannot support writing up until actually empty.

OBJECT AND SUMMARY OF THE INVENTION

It accordingly is an object of the invention to improve a writing instrument such that practically all the writing fluid contained in the writing fluid reservoir can be used for writing or drawing.

For attaining this object, a writing instrument of the above type is equipped according to the invention such that the writing fluid reservoir comprises fibers extending at right angles to, and radially with respect to, the longitudinal axis of the writing fluid conductor.

In other words, in the writing instrument according to the invention, completely unlike known writing instruments, the fibers of the reservoir are arranged such that they extend from the outside and inward, towards the coaxially disposed conductor to communicate in a fluid-conducting manner therewith, whereby the capillary conduits formed by the fibers extend in the radial direction. In this manner, during use, that is when the writing fluid connector sends writing fluid to the writing tip during writing or drawing, the writing fluid is transported from the reservoir toward the conductor. The result is practically complete evacuation of the writing fluid reservoir, because the effective capillary forces do not, as in the known writing instrument, retain the writing fluid in the outer circumferential area of the reservoir but only transport them to the writing fluid conductor.

The conductor inserted into the reservoir is preferably a wick open at the sides and having capillary conduits, which receives writing fluid over its circumferential surface from the radially inner ends of the fibers of the reservoir. A particularly simple design is attained if the front end of the conductor forms the writing tip, because in that case only one structural component is needed for both the conductor and the writing tip.

The invention will be described in further detail below in terms of exemplary embodiment shown in the drawing.

DESCRIPTION OF THE PREFERRED EMBODIMENT

Figure 1:
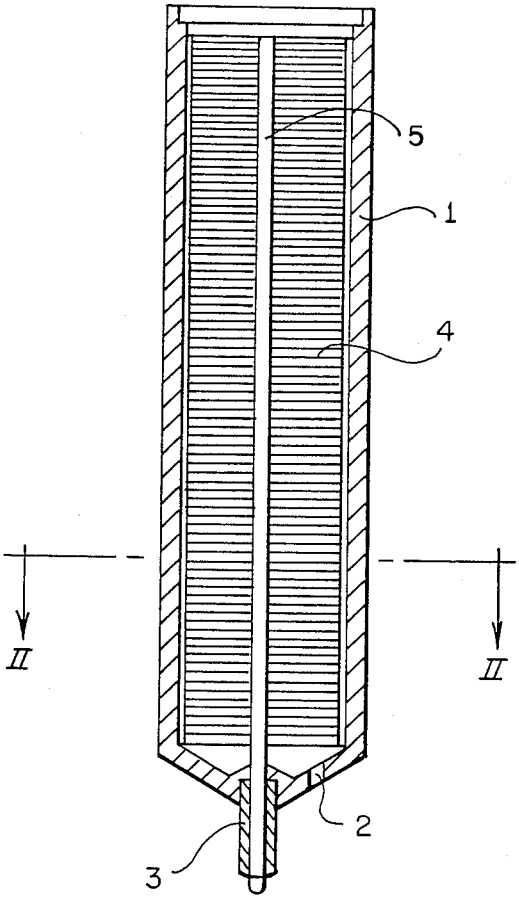
FIG. 1 is a section taken through a writing instrument.
Figure 2:
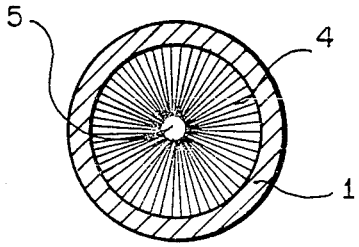
FIG. 2 is a section taken along the line II—II of FIG. 1.

The writing instrument shown has a substantially cylindrical elongated housing 1, in the front end of which a passageway opening is provided, into which a supporting tube 3 is inserted. Also located in the front end surface of the housing 1 is a ventilation bore 2, by way of which an equalization of pressure between the interior of the housing 1 and the environment is accomplished.

A cylindrical writing fluid reservoir 4 is inserted into the housing 1, extending substantially through the entire length of the housing. As shown, the reservoir comprises individual fibers, which in the direction of their longitudinal extension form capillary conduits, and the longitudinal extension of those fibers is radial, with respect to the axial extension of the housing and reservoir. This means that the fibers extend radially outward, beginning at a writing fluid conductor 5 inserted coaxially into the reservoir. The fibers communicate in a fluid-conducting manner with the conductor 5, typically by direct contact. The conductor 5 preferably is a wick, open at the sides and known for this purpose, which in turn has capillary conduits. The conductor extends axially forward from the reservoir 4 through a passageway opening defined in the housing 1 and the supporting tube 3, so that its front end may form the writing tip of the writing instrument.

In use, the conductor 5 is supplied with writing fluid from the reservoir 4, which is impregnated with writing fluid, for example ink, via the radially extending capillary conduits of the reservoir. This fluid then flows in the conductor 5 axially toward the front to the writing tip and from there is applied to the writing surface.

Having described a preferred embodiment of my invention, it is to be understood that the invention is to be defined by the scope of the appended claim.

I claim:

1. A writing instrument comprising a writing fluid reservoir, in the form of fibers which define capillary conduits, by their outer surfaces in the direction of the longitudinal extensions of each fiber, and having a housing to receive the reservoir and hold a writing tip in its front end, wherein a centrally disposed writing fluid conductor with a longitudinal axis extends coaxially within the reservoir and communicates in a fluid-conducting manner with the writing tip, characterized in that the writing fluid reservoir (4) comprises a plurality of individual fibers extending at right angles to, and radially with respect to, the longitudinal axis of the writing fluid conductor (5) so that said capillary conduits conduct writing fluid radially inward towards a fluid communication with said writing fluid conductor.

2. A writing instrument as defined by claim 1, characterized in that the writing fluid conductor (5) is a wick open at the sides and further comprises longitudinal capillary conduits in direct contact with an inner end of each radially disposed fiber.

3. A writing instrument as defined by claim 1, characterized in that the front end of the writing fluid conductor (5) further comprises a writing tip.

4. A writing instrument as defined by claim 2, characterized in that the front end of the writing fluid conductor (5) further comprises a writing tip.

* * * * *